United States Patent [19]

Thomas

[11] 4,292,749

[45] Oct. 6, 1981

[54] DISPLAY DEVICE FOR COUPON CLIP

[76] Inventor: Claude E. Thomas, Bldg. 36631, Apt. 104, Chatham Hills Apts., Grand River Ave., Farmington, Mich. 48024

[21] Appl. No.: 151,388

[22] Filed: May 19, 1980

[51] Int. Cl.[3] ..... G09F 3/00

[52] U.S. Cl. ..... 40/308; 40/11 R; 40/23 R; 24/67 R; 24/316

[58] Field of Search ..... 40/308, 11, 11 A, 1.5, 40/23 R, 13; 24/67 R, 67.9, 316

[56] References Cited

U.S. PATENT DOCUMENTS

| | | | |
|---|---|---|---|
| 1,648,103 | 11/1927 | Ball | 40/11 R |
| 2,779,114 | 1/1957 | Orthwine | 40/11 R |
| 2,800,732 | 7/1957 | Duran | 40/11 R |
| 3,263,352 | 8/1966 | Fitzpatrick | 40/1.5 X |
| 3,265,297 | 8/1966 | Behrens | 40/308 |
| 3,553,864 | 1/1971 | Karlyn et al. | 40/10 D |
| 4,021,953 | 5/1977 | Couch | 40/308 |

*Primary Examiner*—Gene Mancene
*Assistant Examiner*—Wenceslao J. Contreras
*Attorney, Agent, or Firm*—Andrew E. Pierce

[57] ABSTRACT

A display device for a coupon clip is disclosed which is particularly suited for attachment to a grocery shopping cart.

13 Claims, 2 Drawing Figures

DISPLAY DEVICE FOR COUPON CLIP

BACKGROUND OF THE INVENTION

1. Field of the Invention

This invention relates to a display device and particularly to a device for displaying coupons or the like held in a clip made of metal or thermoplastic or thermosetting material.

2. Description of the Prior Art

It is known from U.S. Pat. No. 3,322,381 to prepare a display device having an elongated support member such as a pole of circular cross section which is set up with its axis in a vertical position and attached thereto a clamping member having integrally joined leg portions which jointly define an axially open channel for receiving the support member and integral therewith securing means for holding a substantially plate-shaped display element to said clamping member. The clamping device is a piece of extruded plastic or metal having a uniform cross section.

It is also known from U.S. Pat. No. 3,228,640 that pipe or conduit can be installed in a building having angle-iron beams and trusses supporting floors and ceilings utilizing support clips which have a unitary structure with an axially open channel for receiving the pipe and opposite and 90° crosswise thereto a slot which is suitable to receive a portion of the angle-iron truss for attachment thereto. The clip is made of an inherently resilient plastic material.

Holding elements which are of extruded plastic are disclosed in U.S. Pat. No. 2,388,297 for use in the construction of miniature buildings and other structures. The holding strips are utilized by inserting a flat sheet having a beaded edge into the holding elements which contain a groove designed to receive said beaded edge. The grooved holder strips are also adapted to self-weld to the beaded edge of the flat strips by the application of heat at the line of contact.

A clip device for mounting accessories on an antenna boom is disclosed in U.S. Pat. No. 3,778,537. The clip is integrally formed of a resilient material and is designed to hold a substantially circular accessory such as a television antenna lead-in wire to an antenna boom of square cross-section.

The novel display device of the invention utilizes a holding clamp which is substantially different from any of the holding clamps disclosed in the prior art. The holding clamp of the invention has both clamping and securing means, said clamping means designed to conformingly engage a substantially circular cross-section support member and said securing means designed to conformingly engage the resilient hinge portion of a coupon clip as disclosed in U.S. Pat. No. 4,126,916.

SUMMARY OF THE INVENTION

There is disclosed a display device for a coupon clip. The device is particularly suitable for attachment to the substantially circular cross-sectional handle of a grocery supermarket shopping cart, so as to keep the coupons held in the coupon clip of U.S. Pat. No. 4,126,916 within view of the person shopping so as to insure that items being promoted by use of coupons are purchased and subsequently the coupon utilized at the time of purchase upon check-out at the supermarket cash register area.

DETAILED DESCRIPTION OF THE INVENTION

The inventive display device for a coupon clip which is adapted for attachment to any elongated support member having a longitudinal axis extending horizontally and being of substantially circular cross-section about said axis comprises a holder and a coupon clip.

The coupon clip is made of a clear thermoplastic material having a thickness in the range of about 1/16 of an inch which comprises a first leg, and a second leg said first leg being shorter than said second leg, a resilient hinge connecting said first and said second legs at one end and resiliently urging the opposite ends of said legs into engagement, said legs generally converging towards each other from said hinge toward the distal end of each leg for removably storing coupons therebetween, one of said legs having an edge generally extending across its width at its distal end, said edge facing the other of said legs and being relatively sharp and having a length in the range of at least 1½ to 3 inches.

The holder comprises a clamping member and securing means of metal or thermosetting or thermoplastic material, said clamping member having two integrally joined leg portions jointly defining an axially open channel for receiving said support member, said channel constituting a resilient wall of about more than 180° but substantially less than 360° of the circumference thereof. The respective terminal parts of said leg portions define therebetween a radial entrance to said channel, said terminal parts being resiliently movable relative to each other in a substantially circumferential direction between a relaxed position in which said entrance is narrower than said cross-sectional width of said support member and an extended position in which said entrance is at least as wide as said cross-sectional width.

The securing means is attached to said clamping member and has two integrally joined leg portions jointly defining an axially open channel constituting a resilient wall of about more than 180° but substantially less than 270° of the circumference thereof, the respective terminal parts of said leg portions defining therebetween a radial entrance to said channel, said terminal parts thereof being resiliently movable relative to each other in a substantially circumferential direction between a relaxed position in which said entrance is narrower than the cross-sectional width of said resilient hinge of said coupon clip and a distended position in which said entrance is at least as wide as the cross-sectional width of said resilient hinge and wherein said clamping member is adapted for attachment to said horizontally extending elongated support member and wherein said securing means is adapted for attachment to said hinge of said coupon clip.

Figure 1:
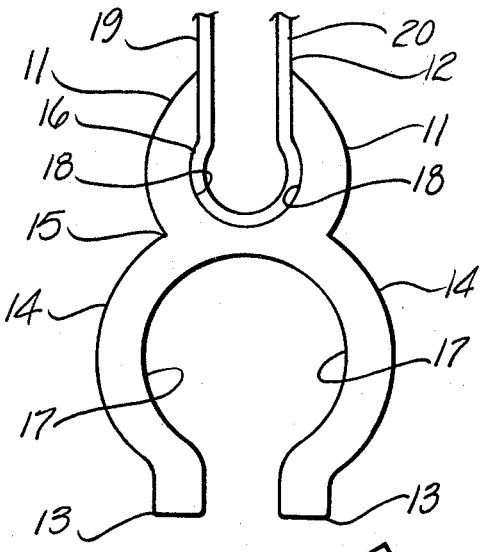
FIG. 1 is a side view of one embodiment of this invention.
Figure 2:
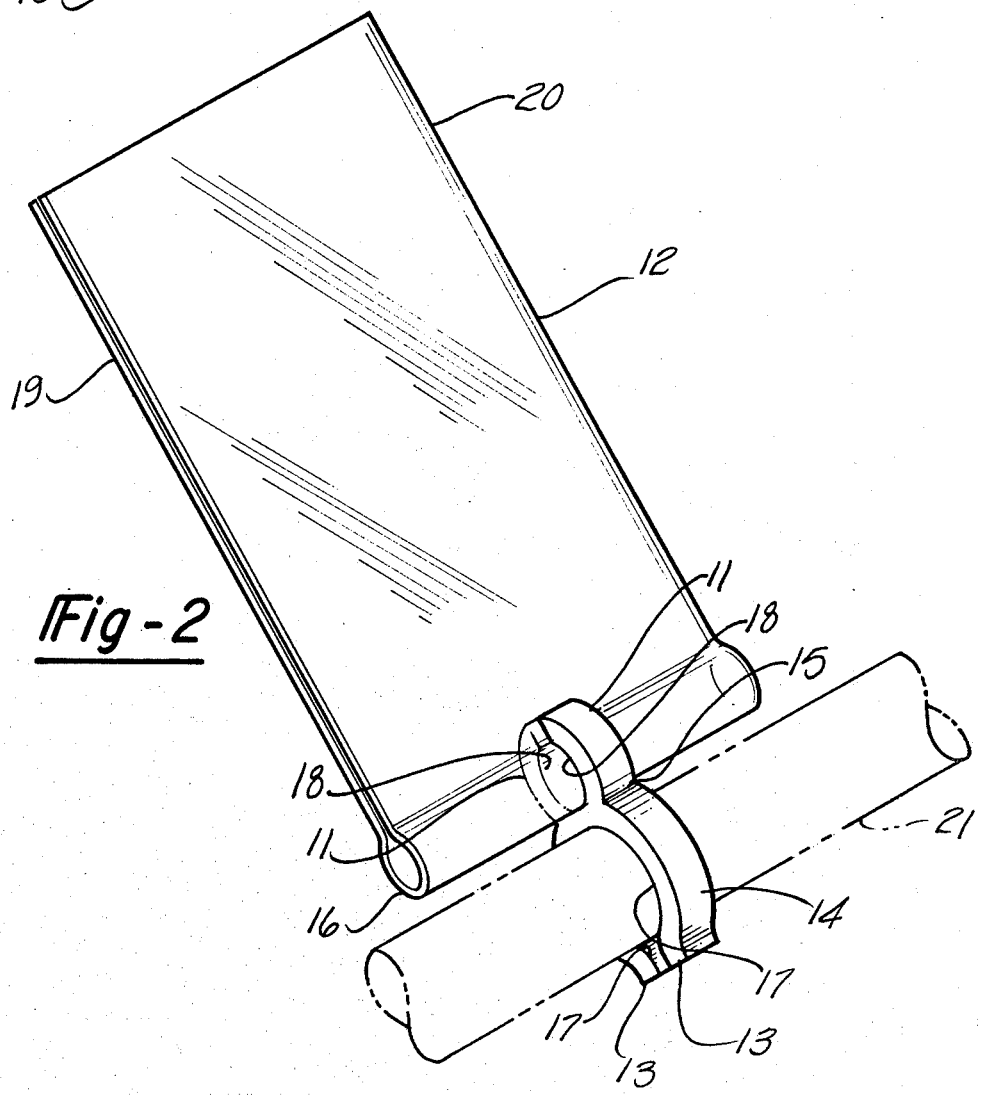
FIG. 2 is a perspective view showing the display device of FIG. 1 mounted on an elongated support member having a longitudinal axis extending horizontally and being of substantially circular cross-section about said axis such as the handle of a shopping cart, as utilized in grocery supermarkets.

Referring to the drawings, the display device structures of FIGS. 1 and 2 are generally made of metal or plastic material; the coupon clip necessarily being made of a clear plastic material, preferably a clear thermoplastic material. The holding part of the device comprises a clamping member and a securing means attached thereto which can be of metal or a thermosetting or thermoplastic material but in any case the holding member must have sufficient resilience so as to conform to the cross-sectional area of the elongated support member and at the opposite end of said holding portion of said device, the securing means must be sufficiently resilient so that even if made slightly smaller in size, it will conform to the cross-sectional width of the resilient hinge of the coupon clip portion of the display device.

Referring now to FIG. 1, there is shown a coupon clip 12 having arms 19 and 20 and a display device which comprises a holder of generally double U-shaped configuration wherein two clamping member legs 14 and two securing means legs 11 are joined to a base 15. The inner surfaces 17 of legs 14 are of substantially circular curvature while the inner surfaces 18 of legs 11 are slightly curved so as to conform to the hinge portion 16 of coupon clip 12. At the distal end of legs 14 are flanges 13 which are substantially parallel to each other. It is noted that the drawings are substantially to scale.

Referring now to FIG. 2, there is shown a coupon clip attached to a substantially circular cross-sectional support member 21 by the holder of the invention. The legs 11 and 14 as well as the base 15 of said holder are resilient and are preformed to be slightly smaller than the parts which they are to embrace. As regards the clamping member legs 14 of the holder, the inner surfaces thereof will frictionally embrace an elongated support member 21 having a substantially circular cross-section. The curved inner surface of the two clamping member legs 14 permits some deflection at base 15 such that said legs will firmly, and resiliently embrace the elongated support member 21 with the inner surfaces of legs 14 tending to lie flat against the sides of said support member.

As regards the securing means legs 11 of the holder, the slight curvature 18 of the inner sides of the two legs 11 permits some outward deflection at base 15 such that the latter will firmly and resiliently embrace the hinge portion 16 of the coupon clip 12 with the inner surfaces of legs 11 tending to lie flat against the sides of the hinge 16. As is the case with the inner surface 17 of the clamping member 14, the inner surface 18 of legs 11 is preformed to be slightly smaller than the hinged portion 16 of coupon clip 12 which it is designed to embrace. Once hinge 16 is inserted between legs 11, the hinge will be frictionally embraced and held firmly in position by the legs 11 of the securing means.

The holder of the invention can be extruded or molded metal or alternatively molded from a suitable plastic having the desired characteristics of resilience and dimensional stability over a wide temperature range, as well as good resistance to moisture and aging. Typical materials which satisfy these requirements are polyester such as polyethylene terephthalate, those plastics sold under the trademark Delrin, and polyurethane molding plastics.

Obviously more than one holder having clamping means and securing means can be attached to an elongated support member having a longitudinal axis and a substantially circular cross-section about said axis for holding a coupon clip, as disclosed in U.S. Pat. No. 4,126,916. The simplicity of the display device of the invention is one of its major advantages. When appropriate metal or plastic materials are selected for use in the holder of the invention, there is nothing to wear out or otherwise become unadjusted and unworkable as is often the case with devices which are not integrally formed and are composed of a number of separate parts which co-act to provide the desired effect.

It should be understood that there has been described above the principles of this invention in connection with a specific embodiment thereof. It should be understood that this description is made only by way of example and is not intended as a limitation of the scope of the invention. It is intended to cover all changes and modifications of the above specific embodiment of the display device of the invention herein chosen for the purpose of disclosure which do not constitute departures from the spirit and scope of the invention as set forth in the appended claims.

What is claimed is:

1. A display device consisting of a coupon clip and an integrally formed holder adapted for attachment to said coupon clip and an elongated support member having a longitudinal axis extending horizontally and being of substantially circular cross section about said axis, said clip comprising a clear thermoplastic material having a thickness in the range of about 1/16 inch comprising: a first leg and a second leg, said first leg being shorter than said second leg, a resilient hinge connecting said first and said second leg at one end and resiliently urging the opposite ends of said legs into engagement, said legs generally converging toward each other from said hinge toward the distal end of each leg for removably storing coupons therebetween, one of said legs having an edge generally extending across its width at its distal end, said edge facing the other of said legs and being relatively sharp and having a length in the range of at least $1\frac{1}{2}$ to 3 inches;

said holder comprising clamping member and a securing means of resilient material said clamping member having two integrally joined leg portions jointly defining an axially open channel for receiving said support member, said channel constituting a resilient wall of about more than 180 degrees but substantially less than 360 degrees of the circumference thereof, the respective terminal parts of said leg portions defining therebetween a radial entrance to said channel, said terminal parts being resiliently movable relative to each other in a substantially circumferential direction between a relaxed position in which said entrance is narrower than said cross sectional width of said support member and an extended position in which said entrance is at least as wide as said cross sectional width; and wherein said securing means is attached to said clamping member and has two integrally joined leg portions jointly defining an axially open channel constituting a resilient wall of about more than 180 degrees but substantially less than 270 degrees of the circumference thereof, the respective terminal parts of said leg portions defining therebetween a radial entrance to said channel, said terminal parts thereof being resiliently movable relative to each other in a substantially circumferential direction between a relaxed position in which said entrance is narrower than the cross sectional width of said resilient hinge of said coupon clip and a distended position in which said entrance is at least as wide as the cross sectional width of said resilient hinge and wherein said clamping member is adapted for attachment to said elongated support member and wherein said securing means is adapted for attachment to said hinge of said coupon clip.

2. The device as set forth in claim 1 wherein said clamping member and said securing means are formed of a resilient metal and constitute a unitary structure.

3. The device of claim 2 wherein said coupon clip first and second legs together with said hinge are integrally formed as a unitary structure.

4. The device of claim 3 wherein said first and second legs and said hinge are integrally formed of a resilient, clear thermoplastic material.

5. The device of claim 4 wherein said clamping member and securing means are made of a resilient thermosetting or thermoplastic material.

6. The device of claim 5 wherein said material is a thermosetting polymer.

7. The device of claim 6 wherein said clamping member and securing means are formed of a resilient polyurethane.

8. The device of claim 1, 2, 3, 5, 6, or 7 wherein said device is adapted for attachment to a shopping cart handle.

9. An integrally formed holder adapted for attachment to a coupon clip having a resilient hinge and to an elongated support member being of substantially circular cross section said holder comprising a clamping member and a securing means of resilient material, said clamping member having two integrally joined leg portions jointly defining an axially open channel for receiving said support member, said channel constituting a resilient wall of about more than 180 degrees but substantially less than 360 degrees of the circumference thereof, the respective terminal parts of said leg portions defining therebetween a radial entrance to said channel, said terminal parts being resiliently movable relative to each other in a substantially circumferential direction between a relaxed position in which said entrance is narrower than said cross sectional width of said support member and an extended position in which said entrance is at least as wide as said cross sectional width; and wherein said securing means is attached to said clamping member and has two integrally joined leg portions jointly defining an axially open channel constituting a resilient wall of about more than 180 degrees but substantially less than 270 degrees of the circumference thereof, the respective terminal parts of said leg portions defining therebetween a radial entrance to said channel, said terminal parts thereof being resiliently movable relative to each other in a substantially circumferential direction between a relaxed position in which said entrance is narrower than the cross sectional width of said resilient hinge of said coupon clip and a distended position in which said entrance is at least as wide as the cross sectional width of said resilient hinge.

10. The holder as set forth in claim 9 wherein said clamping member and said securing means are formed of a resilient metal and constitute a unitary structure.

11. The holder of claim 9 wherein said resilient material is a thermosetting material.

12. The holder of claim 11 wherein said resilient material is a polyurethane.

13. The holder of claim 9 wherein said resilient material is a thermoplastic material.

* * * * *

UNITED STATES PATENT AND TRADEMARK OFFICE

CERTIFICATE OF CORRECTION

PATENT NO. : 4,292,749
DATED : October 6, 1981
INVENTOR(S) : Claude E. Thomas

It is certified that error appears in the above–identified patent and that said Letters Patent are hereby corrected as shown below:

Column 5, line 16, delete "4" and insert ---1---.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*